US005250497A

United States Patent [19]

Fujimura et al.

[11] Patent Number: 5,250,497

[45] Date of Patent: * Oct. 5, 1993

[54] HEAT TRANSFER SHEET

[75] Inventors: Hideo Fujimura; Noritaka Egashira; Tamami Iwata; Naoto Satake, all of Tokyo, Japan

[73] Assignee: Dai Nippon Insatsu Kabushiki Kaisha, Japan

[ * ] Notice: The portion of the term of this patent subsequent to Feb. 9, 2010 has been disclaimed.

[21] Appl. No.: 832,312

[22] Filed: Feb. 7, 1992

Related U.S. Application Data

[63] Continuation of Ser. No. 455,968, Dec. 13, 1989, abandoned.

[30] Foreign Application Priority Data

Dec. 13, 1988 [JP] Japan ..... 63-312878
Dec. 16, 1988 [JP] Japan ..... 63-316323

[51] Int. Cl.[5] ..... B41M 5/035; B41M 5/38

[52] U.S. Cl. ..... 503/227; 428/195; 428/480; 428/913; 428/914

[58] Field of Search ..... 8/471; 428/195, 480, 428/913, 914; 503/227

[56] References Cited

U.S. PATENT DOCUMENTS 4,559,273 12/1985 Kutsukake et al. ..... 428/484

FOREIGN PATENT DOCUMENTS 0138483 4/1985 European Pat. Off. ..... 503/227
0163145 12/1985 European Pat. Off. ..... 503/227
0222374 5/1987 European Pat. Off. ..... 428/480
0279467 8/1988 European Pat. Off. ..... 503/227

*Primary Examiner*—B. Hamilton Hess
*Attorney, Agent, or Firm*—Parkhurst, Wendel & Rossi

[57] ABSTRACT

A heat transfer sheet including comprising a heat migratable dye layer formed on one surface of a substrate film and a heat-resistant layer formed on the other surface, of the substrate film, wherein the substrate film includes a polyethylene naphthalate.

5 Claims, No Drawings

HEAT TRANSFER SHEET

This is a continuation of application Ser. No. 07/455,968 filed Dec. 13, 1989, now abandoned.

BACKGROUND OF THE INVENTION

This invention relates to a heat transfer sheet and, more particularly, to a heat transfer sheet to be used in a sublimation transfer system of the heat-sensitive type, or a heat transfer sheet to be used in an electrothermal transfer system.

In the background art, various heat transfer methods have been known, and among them, there has been proposed a method in which a sublimable dye is used as a recording agent, and is carried on a substrate film such as polyester film to form a heat transfer sheet, and various full color images are formed on a transferable material dyeable with a sublimable dye. For example, an image receiving sheet having a dye receptive layer on paper, plastic film, etc. In this case, thermal heads of a printer are used as the heating means, and a large number of color dots of 3 or 4 colors are transferred onto a transferable material, thereby reproducing the full color image of the original with color dots of multiple colors.

The image thus formed is very sharp and also excellent in transparency, because the colorants used are dyes, and therefore the thus obtained image has excellent reproducibility and gradation of intermediate color. It has been rendered possible to form an image similar to the image obtained by the off-set printing or the gravure printing of the prior art, and also of high quality comparable with full color photographic images.

As the substrate film for the heat transfer sheet of the sublimation transfer type as mentioned above, papers such as condenser paper may be also employed in some cases, but such thin paper has low strength, particularly weak bursting strength, and therefore, it is desirable to use a film of tough plastic such as polyester resin as the substrate film.

However, even in such a case, there will ensue such problem as follows. That is, during printing, high heat of around 250° to 300° C. or higher is applied by the heating heads on the heat transfer sheet, whereby the phenomenon of partial fusion of the substrate film onto the heads occurs and delivery of the heat transfer sheet is obstructed.

This phenomenon is called sticking, which not degrades the sharpness of recording, but also brings about troubles in operation such as defective running of the heat transfer sheet, etc. Also, wrinkles are formed by heat on the substrate film, whereby color slippage of the dye image may also occur. This is particularly liable to be generated when the shade of the printed image is partially imbalanced.

As a measure which enables use of a plastic film as the substrate film of heat transfer sheet, there has been proposed a provision of a heat-resistant protective layer such as a thermosetting resin, etc. on the surface opposite to the dye layer, etc.

However, even by use of these methods, if the heat-resistant protective layer is made thick to an extent effective for prevention of the sticking phenomenon for effecting speed-up of recording, resolution of the printed image is lowered and hence it cannot be still a sufficient solving measure under the present situation.

On the other hand, there also has been known a heat transfer sheet of the electrothermal transfer type. In the heat transfer system as described above by use of a thermal head, since heat efficiency of thermal head is limited, there is the problem that migration of heat migratable dye is insufficient and the problem that high speed printing cannot be done easily. Therefore, there has been developed the electrothermal transfer system as the technique which forms images of high density at high speed. By passing electric current through this type of heat transfer sheet having a resistance layer which is capable of generating heat by electric current and a heat migratable dye layer from electrode heads, heat generation corresponding to image information signals occurs in the resistance layer. As the result of heating of the dye layer with the generated heat, the dye is migrated onto the image receiving layer to form images.

As the electrothermal transfer sheet of the background art, there is one having a resistance layer which is prepared by dispersing electroconductive carbon powder in a binder dissolved in a solvent, coating the dispersion on a film such as polyethylene terephthalate, and having a heat migratable dye layer on the opposite surface of the sheet. In the electrothermal transfer system, since heat generation is effected by use of electrode heads directly on the sheet and internally in the resistance layer, thermal loads onto the resistance layer or the substrate film are great, whereby thermal fusion of the head electrodes with the resistance layer or the substrate film may have sometimes occurred to bring about troubles of running or printed images.

Thus, in the electrothermal transfer recording system, heat generation is carried out by use of electrode heads in the resistance layer directly, so that the temperature of the resistance layer and the substrate film will more readily become higher locally and the thermal load onto the resistance layer or the substrate film is very great as compared with the heat-sensitive sublimation transfer recording system. For this reason, in the background art, the substrate film made of polyethylene terephthalate (PET), etc. has poor mechanical strength during heat generation, so that wrinkling and breaking phenomena have sometimes occurred.

Also, due to friction with the electrode heads and defective adhesion to the substrate sheet, the resistance layer may be cut off, or the resistance layer may be melted by high temperature heat generation. The thus cut scum or the melted product may be attached between the electrode heads, whereby excessive current may flow between the electrodes, resulting in thermal fusion between the current passage type heat transfer sheet and the electrode heads; consequently, such thermal function causes problems of bringing about defective running or troubles in printed images.

SUMMARY OF THE INVENTION

Accordingly, an object of the present invention is to provide a heat transfer sheet, which can give a sharp image with sufficient density without causing breaking of the substrate film, generation of wrinkle and sticking during transfer of the heat-sensitive type method or the electrothermal type transfer method.

For accomplishing the above object, the heat transfer sheet according to the present invention is a heat transfer sheet, comprising a heat migratable dye layer being formed on one surface of a substrate film and a heat-resistant layer being formed on the other surface of the substrate film, wherein the substrate film comprises a polyethylene naphthalate.

Generally speaking, the energy necessary for recording in the heat-sensitive type heat transfer recording method is about 0.7 mJ/dot or less in the case of the melt transfer method. In the case of the sublimation method, it is about 2.3 mJ/dot, and the heat content applied on the substrate film during recording is 3-fold or more of the melt transfer method. From this point of view, in the heat-sensitive sublimation transfer method, particularly heat resistance of the heat transfer sheet is important. The present inventor has found that the problem of sticking in the sublimation transfer method requiring particularly high heat resistance can be solved easily by use of a film comprising a linear polyester containing naphthalene dicarboxylic acid as the dibasic acid component, particularly polyethylene naphthalate as the substrate film of the heat transfer sheet.

Whereas, generally speaking, for making resolution of printed images high, it is desirable to make the thickness of the substrate thinner so that the printing heat may be rapidly transmitted to the dye layer. However, when the substrate is made thinner, then wrinkles are liable to be generated on the sheet, thereby to causing lowering of printing operability and poor image quality.

In the present invention, by providing a heat-resistant layer on the surface of the substrate where the dye layer has not been formed, the above-mentioned problem has been solved successfully. Thus, by assigning the function as a substrate and the function as a heat-resistant layer separately and also integrating these layers, cancellation of wrinkling and sticking and improvement of resolution can be realized all at once.

In the heat transfer sheet to be used for electrothermal transfer, a resistable heat-resistant substrate film by use of a heat-resistant resin having carbon, etc. kneaded therein has been proposed, and also it can be prepared by use of a polyethylene naphthalate, but if it contains a large amount of carbon, it becomes difficult to form a thin film of 15 μm or less and also the strength itself becomes weaker, thereby to ensue problems such as film breaking during printing.

Therefore, in the present invention, by constituting the heat-resistant layer from a resistance layer which is capable of generating heat by electric current, an electrothermal transfer sheet having excellent strength and being capable of giving high quality image can be obtained.

DETAILED DESCRIPTION OF THE INVENTION

The film to be used as the substrate film for the heat transfer sheet of the present invention is a polyethylene naphthalate (hereinafter called "PEN") such as polyethylene naphthalene dicarboxylate, of which the dibasic acid component is naphthalene dicarboxylic acid, preferably comprising naphthalene-2,6-dicarboxylic acid as the main component. Preferably, it may be a polyethylene-2,6-naphthalene dicarboxylate, and the dibasic acid components may preferably comprise 85 mole % of naphthalene-2,6-dicarboxylic acid. Also, other than naphthalene-2,6-dicarboxylic acid, other dibasic acid components, for example, naphthalene-2,7-dicarboxylic acid, aliphatic dicarboxylic acid, isophthalic or terephthalic acid may be also used as a mixture.

Also, as the diol component, 85 mole % or more of ethylene glycol may be preferably contained.

Also, in the PEN film in the present invention, fine particles such as fine particulate silica, stabilizers such as phosphoric acid, sulfurous acid and esters thereof may also be contained.

The PEN film in the present invention may be preferably formed into a biaxially oriented film by stretching by use of general methods.

Also, the PEN film in the present invention also may be applied with annealing treatment in order to improve heat resistance. As the annealing treatment method, there is, for example, the method in which the film is closely contacted on a metal roll of 130° C. and heated for about 10 seconds. However, the annealing method is not limited to this method at all.

If the thickness of the substrate film of the heat transfer sheet is too thin, heat resistance is deficient, while if it is too thick, migration efficiency of the dye becomes lower. Hence, its preferable thickness may be 0.5 to 50 μm, particularly preferably, it may be of 1 to 20 μm. The shape may be a sheet-shaped film cut into predetermined dimensions, or alternatively a continuous or wind-up film, and further it may be a tape-shaped film with narrow width.

The substrate film particularly preferable in the present invention is a biaxially oriented linear polyester containing 85 mole % or more of naphthalene-2,6-dicarboxylic acid as the main component, with the sum of the Young's moduli in the length direction and the width direction of the substrate film being 1200 kg/mm$^2$ or more, the strength at break being 50 kg/mm$^2$ or more, the density being 1345 g/cm$^3$ to 1365 g/cm$^3$ and the glass transition temperature being 70° C. or higher. Such PEN film may be, for example, commercially sold under the trade name of "Q film" from Teijin K.K., Japan and readily available from the market. In particular, the substrate film in the present invention may be preferably one having a surface roughness Ra=0.003 μm to 0.050 μm.

In the case where the adhesive force with the dye layer formed on its surface is poor, the substrate film may be preferably applied on its surface with primer treatment or corona discharging treatment.

The sublimable (heat migratable) dye layer to be formed on the substrate film is a layer having a dye carried with any desired binder resin.

As the dye to be used, all of the dyes which can be used in the heat transfer sheets known in the art can be effectively used for the present invention, and are not particularly limited. For example, some preferable examples may include, as red dyes, MS Red G, Macrolex Red Violet R, Seres Red 7B, Samaron Red HBSL, SK Rubin SEGL, Bimicron SNVP 2670, Resolin Red F3BS, etc.; as yellow dyes, Holon Brilliant Yellow S-6GL, PTY-52, Macrolex Yellow 6G, Teradyl Golden Yellow 2RS, etc.; as blue dyes, Kayaset Blue 714, Waxolin Blue AP-FW, Holon Brilliant Blue S-R, MS Blue 100, Daito Blue No. 1, etc.

As the binder resin for carrying the heat migratable dye as described above, all of those known in the art can be used. Examples of preferable one may include cellulose resins such as ethyl cellulose, hydroxyethyl cellulose, ethylhydroxy cellulose, hydroxypropyl cellulose, methyl cellulose, cellulose acetate or cellulose acetate butyrate; vinyl resins such as polyvinyl alcohol, polyvinyl acetate, polyvinyl butyral, polyvinyl acetoacetal, polyvinyl pyrrolidone, polystyrene, polyacrylonitrile or polyacrylamide; polyesters; and others, and among these, cellulose type, polyvinyl acetoacetal type, polyvinyl butyral type and polyester type are particularly preferred.

The dye layer, when the image to be formed is a mono-color, can be formed at each predetermined pattern to be formed by selecting any desired one color from among the dyes as mentioned above. While, when the image to be formed is a multi-color image, can be formed by selecting those with predetermined hues from among appropriate cyan, magenta, yellow, black, etc. in any desired combination.

The dye layer in the heat transfer sheet of the present invention is formed basically of the materials as described above, but otherwise various additives similar to those known in the art can be included, if necessary.

Such dye layer may be preferably formed by adding the above-mentioned sublimable dye, binder resin and other optical components in an appropriate solvent and dissolve or disperse them in the solvent to prepare a coating material or ink composition for formation of dye layer, and coating and drying this on the above-mentioned substrate film.

The thus formed dye layer has a thickness of about 0.2 to 5.0 μm, preferably 0.4 to 2.0 μm. The sublimable dye in the dye layer may be preferably present in an amount of 5 to 90% by weight, preferably 10 to 70% by weight based on the weight of the dye layer.

Also, in the present invention, between the substrate film and the dye layer, a priming layer may be provided, if necessary. The priming layer is provided for improvement of adhesion between the substrate film and the dye layer or protection of the substrate film. However, for example, when the priming layer is made of a hydrophilic resin, it has the function of a barrier layer which prevents the dye or the migration of the dye from the dye layer to the substrate film. As the material for formation of the priming layer, for example, there may be effectively employed those with smaller diffusion coefficient of the dye in the dye layer than the substrate film, such as polyester resins, polyurethane resins, acrylic polyol resins, vinyl chloride-vinyl acetate copolymer resins, or cellulose resins such as cellulose acetate or methyl cellulose, polyvinyl alcohol or gelatin.

In the present invention, it is also preferable to provide a lubricating layer on the surface of the substrate film opposite to the dye layer for improvement of the lubricating characteristics between the thermal head and the substrate film. As the material for formation of such lubricating layer, there may be included phosphoric acid esters, silicone oils, graphite powder, silicone resins, fluorine resins and the like.

In the present invention, a heat-resistant layer may be also provided on the other surface of the substrate film. As the heat-resistant layer, one having lubricity together with heat resistance may be preferable. As such heat-resistant lubricating layer, materials which known per se can be used. Preferably, it may be formed of from a polyol, for example, a polyalcoholic polymeric compound and a polyisocyanate compound and a phosphoric acid ester compound.

Such polyalcoholic polymeric compound may be desirably selected from among polyvinyl butyral resins, polyvinyl acetoacetal resins, polyester resins, vinyl chloride/vinyl acetate copolymers, polyether resins, polybutadiene resins, acrylic polyols, prepolymers of urethane or epoxy or nitrocellulose resins, cellulose acetate propionate resins, cellulose acetate butyrate resins or cellulose acetate resins having hydroxyl groups.

The above-mentioned resins, in addition to those having hydroxyl groups in the polymer units, may be also those having unreacted hydroxyl groups at the terminal ends or in the side chains. Particularly preferable polyol polymeric compounds in the present invention are polyvinyl butyral resins and polyvinyl acetoacetal resins which can form reaction products excellent in heat resistance. As the polyvinyl butyral resins, those having molecular weights as high as possible and containing hydroxyl groups which are reaction sites with polyisocyanates are preferable. Particularly preferable of polyvinyl butyral resins are those having molecular weights of 60,000 to 200,000, glass transition temperature of 60° to 110° C., the weights of the vinyl alcohol moieties contained of 15 to 40% by weight.

As the polyisocyanates to be used in forming the above-mentioned heat-resistant lubricating layer, polyisocyanates such as diisocyanates or triisocyanates may be included, and these may be used either as single component or mixtures. Specifically, there may be included:

para-phenylene diisocyanate,
1-chloro-2,4-phenyl diisocyanate,
2 chloro-1,4-phenyl diisocyanate,
2,4-toluene diisocyanate,
2,6-toluene diisocyanate,
hexamethylene diisocyanate,
4,4'-biphenylene diisocyanate,
triphenylmethane triisocyanate,
4,4',4''-trimethyl-3,3',2'-triisocyanate,
2,4,6-triphenylcyanurate, etc.

The isocyanates may be used in amounts normally of 1 to 400 parts by weight, preferably 5 to 300 parts by weight, per 100 parts by weight of polyalcoholic polymeric compounds.

The phosphoric ester compound is to give lubricity to the heat-resistant slip layer. Specifically, GAFAC RD720 manufactured by Toho Kagaku, Japan, Prisurf A-208S of Daiichi Kogyo Seiyaku, Japan, may be employed. Such phosphoric acid ester compound may be used at a ratio of 1 to 150 parts by weight, preferably 5 to 100 parts by weight, per 100 parts by weight of the polyalcoholic polymeric compound. Since the phosphoric acid ester compound is added as the lubricant under the state dissolved in molecules in the binder, as compared with the case where a solid lubricant such as myca or talc is added, there is the advantage that no coarseness occurs at the printed portion.

The heat-resistant lubricating layer should preferably have a film thickness of 0.05 to 5 μm, preferably 1 to 2 μm. If the film thickness is thinner than 0.05 μm, the effect as the heat-resistant lubricating layer not sufficient, while if it is thicker than 5 μm, heat transmission from the thermal head onto the dye layer is degraded, resulting in the drawback that the printing density is lowered.

The heat transfer sheet in the present invention may also have an adhesion improving layer between the heat-resistant lubricating layer and the substrate film.

As the adhesion improving layer, those which can consolidate adhesion between the substrate film and the heat-resistant lubricating layer may be employed by coating singly or in a mixture of, for example, polyester resins, polyurethane resins, acrylic polyol resins or vinyl chloride-vinyl acetate copolymer resins. Also, if necessary, a reactive curing agent such as polyisocyanates may be also added. Further, a coupling agent such as titanate and silane may be also used. Also, if necessary, two or more layers may be laminated.

The heat transfer sheet in the present invention may also contain substantially an antistatic agent, and as the antistatic agent, cationic surfactants (e.g., quaternary ammonium salt, polyamine derivative, etc.), anionic surfactants (e.g., alkyl phosphate, etc.), amphoteric surfactants (e.g., those of betaine type, etc.) or nonionic surfactants (e.g., fatty acid esters, etc.) can be used, and further those of polysiloxane can be used also.

The image-receiving sheet to be used for formation of image by use of the above-mentioned heat transfer sheet may be any one that its recording surface has dye receptivity. In the case where the image-receiving sheet is a paper, metal, glass or synthetic film or sheet, which has no dye receptivity, there may be formed a dye receptive layer from a resin having excellent dye receptivity on at least one side of surface thereof. Also, in such dye receptive layer, it is preferable to incorporate a solid wax such as polyethylene wax, amide wax or Teflon powder, a surfactant of silicone, fluorine, phosphoric acid ester, a silicone oil.

The means for imparting heat energy during heat transfer to be used in the method of the present. invention, any imparting means known in the art can be used and, for example, by controlling the recording time by means of a recording device such as a thermal printer (e.g., Video Printer VY-100, manufactured by Hitachi Seisakusho, Japan), heat energy of about 5 to 100 $mJ/mm^2$ can be imparted, whereby the intended object can be sufficiently accomplished.

According to the present invention, by use of the substrate film comprising a linear polyester containing naphthalene dicarboxylic acid as the dibasic acid component, a heat transfer sheet which gives a sharp image with sufficient density can be provided without causing sticking to occur during heat transfer printing.

Also, by providing a heat-resistant layer on the back of the substrate film, the problems such as wrinkling or sticking can be prevented further. In this case, frictional force between the thermal head and the heat transfer sheet is also reduced and the noise during printing is lowered, and durability of the thermal head can be improved.

Also, by using a polyethylene naphthalate film for the substrate film of the heat transfer sheet and providing a heat-resistant layer on the back side, a thin heat transfer sheet which makes the image sharp and has high heat resistance can be obtained.

The heat energy given by the thermal head, owing to thin heat transfer sheet, is transmitted from the thermal head in the vertical direction of such that the backsubstrate film-dye layer-dye receptive layer, with little energy dissipation toward the horizontal direction. For this reason, gradation reproducibility per one dot of thermal head is excellent, without dot blur, and sharper image can be obtained. Particularly, for color image of precise figure or photography for which high resolution of a thermal head density of 16 dots/mm or more is needed, the heat transfer sheet of the present invention is very effective.

Next, the case where the present invention constitutes an electrothermal transfer sheet is to be described.

In the electrothermal type heat transfer sheet, the heat-resistant layer comprises a resistant material having the property of generating heat by electric current. In this case, by forming the substrate film from a polyethylene naphthalate, problems such as breaking, thermal fusion or wrinkling of the substrate film, which are caused by high temperature generated during recording, can be effectively prevented.

In the present invention, the above-mentioned resistance layer can be formed from a resistance layer having excellent heat resistance, which comprises a resin crosslinked by ionized radiation or heat as the constituent material.

Further, in the present invention, by providing a heat-resistant primer between the above-mentioned substrate film and the resistance layer, adhesion between the both layers can be further improved, thereby preventing cut-off of the resistance layer through friction with the electrode head and inhibiting generation of cut scum to give printed image of higher quality.

Also, in the current passage type heat transfer sheet, since the substrate film and the resistance layer are separately laminated, by assigning the function as the substrate and the function as the resistance layer separately from each other and also integrating them, the thickness as the substrate film itself can be made thinner. Accordingly, the heat generated can be utilized efficiently as the printing energy thereby to exhibit the effect that images of quality images can be formed together with improvement of heat efficiency.

In the following, the respective constituent materials are to be described.

In the present invention, the heat migratable dye layer to be formed on the substrate film is a layer having a heat migratable dye used in conventional heat transfer sheet as mentioned below carried with any desired binder. For example, preferable dyes may include, as red dyes, Sumiplas Red 301, PTR-51, Seriton Red SF-7864, Sumiplas Red B, Mihara Oil Red, etc.; as yellow dyes, PTY-51, ICI-C-5G, Miketon Polyester Yellow YL, etc.; and as blue dyes, Kayaset Blue A-2R, Diaresin Blue N, PTB-76, PTV-54, etc.

As the binder resin for carrying the heat migratable dye, all of those known in the art can be used, and examples of preferable ones may include cellulose resins such as ethyl cellulose, hydroxyethyl cellulose, ethylhydroxy cellulose, hydroxypropyl cellulose, methyl cellulose, cellulose acetate, or cellulose acetate butyrate, vinyl resins such as polyvinyl alcohol, polyvinyl acetate, polyvinyl butyral, polyvinyl acetal, polyvinyl pyrrolidone or polyacrylamide, and among them, particularly preferably resins are polyvinyl butyral and polyvinyl acetal with respect to heat resistance and migratability of dyes.

The heat migratable dye layer to be used in the present invention is formed basically from the above-mentioned material. If necessary, various additives known in the art also be included.

Such heat migratable dye layer may be formed preferably by adding the above-mentioned heat migratable dye, binder resin and other optional components into an appropriate solvent, dissolving or dispersing the respective components in the solvent to prepare a coating material or an ink composition for formation of dye layer, and coating and drying this on the above-mentioned substrate film.

The heat migratable dye layer thus formed has a thickness of about 0.2 to 5.0 μm, preferably 0.4 to 2.0 μm. The heat migratable dye in the dye layer may suitably exist in an amount of 5 to 90% by weight, preferably 10 to 70% by weight.

The resistance layer which is capable of generating heat by electric current, in the present invention, is formed by preparing an electroconductive coating material or ink containing zinc oxide, titanium oxide, cadmium sulfide, graphite, electroconductive carbon black, metal powder, metal fiber, etc., and coating the coating material or ink on the surface of the substrate film on the surface of the opposite side to that where the heat migratable dye layer is formed.

As the electroconductive coating material or ink, one having the powder of the above-mentioned electroconductive agent in a vehicle comprising a solvent and a binder conventionally used in coating material or ink may be used, and the resistance layer may be formed by use of these coating materials or inks according to conventional coating method and coating mans. The resistance layer may preferably have a thickness of about 1 to 30 μm, and a resistance value within the range of about 0.5 to 5 KΩ/□.

As the resin or the resistance layer, there may be employed thermoplastic resins, including polyester resins, polyacrylate resins, polyvinyl acetate resins, polystyrene-acrylate resins, polyurethane resins, polyolefin resins, polystyrene resins, polyvinyl chloride resins, polyether resins, polyamide resins, polycarbonate resins, polyethylene resins, polypropylene resins, polyacrylamide resins, polyvinyl acetal resins such as polyvinyl butyral, etc.

For the purpose of imparting heat resistance to the resistance layer resin, it is desirable to crosslink the resin by heat. As such resistance layer resin, it is preferable to use a resin having reactive groups such as OH groups, etc. in combination with a curing agent. Representative examples may include polyvinyl butyral and polyisocyanate, acrylic polyol and polyisocyanate, cellulose acetate and titanium chelating agent, or polyester and organic titanium compound.

Also, ionized radiation can also be used, and in such case, a crosslinking aid (polyfunctional monomer) can also be added in the above-mentioned resin for resistance layer. In this case, the reactive groups such as OH groups, etc. are not necessarily required. As such polyfunctional monomer, there may be included, tetraethylene glycol dimethacrylate, divinylbenzene, diallyl phthalate, triallyl isocyanurate, trimethylolpropane tri(meth)acrylate, trimethylolmethane tetra(meth)acrylate, trimethoxyethoxy vinylsilane, etc. Also, oligomers or macromers, etc. can also be used.

Of the above resistance layer resins, no polyfunctional monomer may be added in polyethylene resins, polyacrylate resins, polyacrylamide resins or polyvinyl acetate resins which is crosslinkable by ionized radiation, or resins having reactive groups such as (meth)acrylic group or vinyl group.

As the ionized radiation, ultraviolet ray (UV) and electron beam (EB) are preferable, and as ultraviolet ray, those from various known ultraviolet ray generators can be used. When ultraviolet ray is used as the ionized radiation, it is preferable to incorporate previously a photosensitizer, a polymerization initiator or a radical generating agent in the resistance layer. On the other hand, when electron beam is used as the ionized radiation, similarly known electron beam generation sources can be used. In this case, addition of a photosensitizer, a polymerization initiator or a radical generating agent is not necessarily required.

When crosslinking and curing are performed through the curing reaction by use of ionized radiation such as EB and UV etc., the energy necessary for the curing reaction of ionized radiation, since the penetrating force of energy (depth reached by energy from the irradiated surface) is inversely proportional to the mass (specific gravity) of the substance to be transmitted through, may be advantageously EB irradiation with stronger penetration force than UV for curing of an ink with greater specific gravity.

The resistance layer can be formed by adding a solvent and an electroconductive substance such as carbon black, etc. into the above-mentioned resistance layer resin, form an ink by use of a dispersing or kneading instrument such as sand mill, ball mill, three rolls, kneader or laboplasto mill, adding a polyfunctional monomer or a curing agent thereinto, if necessary, .to form a resistance layer ink and forming a resistance layer according to the solvent coating method, the hot melt method or the extrusion coating (EC) method. Also, when ionized radiation is used, it is also possible to perform coating with a polyfunctional monomer as the diluent without use of a solvent. The resistance layer formation method has been practiced according to the above method, but is not particularly limited.

The thickness of polyethylene naphthalate (PEN) may be preferably 2 to 10 μm, because in the case of electrothermal transfer recording, thermal load on the substrate film is great as described above.

Also, in the present invention, a heat-resistant primer may be also provided between the substrate film and the resistance layer. In this case, the heat-resistant primer may comprise a resin such as polyvinyl butyral resin, acrylic polyol resin, polyethyleneimine resin, polyester resin, polyurethane resin, etc. and a polyisocyanate. Its thickness may be about 0.1 to 2 μm, preferably 0.5 to 1 μm. As the printer to be used, any printers known in the art are available and not particularly limited.

As an example of the method for transferring an image by use of the electrothermal transfer sheet of the present invention and an image receiving sheet is as follows. For example, an electrothermal transfer device having heads by use of copper wires of about 50 μm in diameter being applied with nickel plating at their tip ends and being arranged at intervals of 8/mm can be used. This head has flat plated-shape having the arrangement of copper wires with a distance of about 0.3 mm. A voltage of about 20 V is applied between the pair of electrodes, thereby printing can be done under the condition of a delivery speed of 20 mm/sec.

The present invention is described in more detail below by referring to specific Examples. In the sentences, parts or % are based on weight, unless otherwise noted.

EXAMPLE A1

On one surface of a 4.5 μm thick polyethylene-2,6-naphthalene dicarboxylate film ("Q film", manufactured by Teijin K.K., Japan), a polyester type priming layer was provided and on its surface was coated by a wire bar an ink composition for formation of a dye layer having the composition shown below to a coated amount after drying of 1.2 g/m$^2$ and dried to form a dye layer.

| Ink composition | |
|---|---|
| Disperse dye (Kayaset Blue 714, C.I. Solvent Blue 63, manufactured by Nippon Kayaku K.K., Japan) | 4.0 parts |
| Polyvinyl butyral resin ("Ethlec BX-1", manufactured by Sekisui Kagaku, Japan) | 4.3 parts |
| Methyl ethyl ketone/toluene (weight | 80.0 parts |

-continued

| Ink composition |
|---|
| ratio 1/1) |

Next, on the surface of the above substrate film opposite to the dye layer was coated a methyl ethyl ketone solution of a phosphoric acid ester (Daiichi Kogyo Seiyaku, Japan, "Prisurf A-208S"), followed by air drying, to obtain a heat transfer sheet of the present invention.

COMPARATIVE EXAMPLE A1

By use of a 4.5 μm polyethylene terephthalate film as the substrate film, and the dye layer and the phosphoric acid layer were formed in otherwise the same manner as in Example A1 to obtain a heat transfer sheet of comparative Example.

EXAMPLE A2

On one surface of the substrate film as in Example A1, an ink composition for formation of a heat-resistant lubricating layer was coated by a wire bar and dried in hot air to form a heat-resistant lubricating layer.

| Ink composition | |
|---|---|
| Polyvinyl butyral resin (manufactured by Sekisui Kagaku, Japan, "Ethlec BX-1") | 4.5 parts |
| Toluene | 45 parts |
| Methyl ethyl ketone | 45.5 parts |
| Phosphoric acid ester (Daiichi Kogyo Seiyaku, Japan, "Prisurf A-208S") | 0.45 part |
| Diisocyanate "Takenate D-110N" 75% ethyl acetate solution | 2 parts |

The above film was subjected to the curing treatment by heating in an oven at 60° C. for 12 hours. The amount of the ink coated after drying was found to be about 1.2 g/m$^2$. Next, on the surface of the above film opposite to the heat-resistant lubricating layer was formed a dye layer in the same manner as in Example A1 to obtain a heat transfer sheet of the present invention.

COMPARATIVE EXAMPLE A2

By use of a 4.5 μm polyethylene terephthalate film, and the heat-resistant lubricating film and the dye layer were provided in otherwise the same manner as in Example A2 to obtain a heat transfer sheet of comparative Example.

REFERENCE EXAMPLE A1

On one surface of a synthetic paper ("Yupo FRG-150", thickness 150 μm, manufactured by Oji Yuka Synthetic Paper, Japan), a coating solution having the following composition was coated at a ratio to 10.0 g/m$^2$ on drying and dried to obtain a heat transferable sheet.

| Coating solution composition | |
|---|---|
| Polyester (Vyron 600, manufactured by Toyobo, Japan) | 11.5 parts |
| Vinyl chloride/vinyl acetate copolymer (VYHH, manufactured by UCC) | 5.0 parts |
| Amino-modified silicone (KF-393, manufactured by Shinetsu Kagaku, Japan) | 1.2 parts |
| Epoxy-modified silicone (X-22-343, | 1.2 parts |

-continued

| Coating solution composition | |
|---|---|
| manufactured by Shinetsu Kagaku, Japan) | |
| Methyl ethyl ketone/toluene/cyclohexanone (weight ratio 4:4:2) | 102.0 parts |

The heat transfer sheets of the above-described Example A1 and Comparative Example A1 and the heat-transferable sheet were superposed on one another with polyvinyl butyral, polyvinyl acetal, the respective dye layers being opposed to the dye receiving face, and recording was performed over substantially the entire width of the image-receiving sheet by a thermal head from the back of the heat transfer sheet under the conditions of a head application voltage of 12 V, and application time of 10.0 msec, and also, in the case of the heat transfer sheets of Example A2 and Comparative Example A2, printing was performed on half of one side of the image-receiving sheet under the same conditions as mentioned above to obtain the results shown below in Table 1.

TABLE 1

| | |
|---|---|
| Example A1 | no sticking phenomenon of thermal head recognized at all, but clear dye image obtained. |
| Comparative Example A1 | during printing, heat transfer sheet thermally fused to thermal head, and no printing possible. |
| Example A2 | no sticking phenomenon of thermal head recognized at all, but clear dye image obtained. |
| Comparative Example A2 | during printing, wrinkles formed on film by heat of thermal head, and dye image obtained had color slippage formed thereon. |

EXAMPLES A13–A5, COMPARATIVE EXAMPLES A3–A7

After formation of a heat-resistant lubricating layer on one surface of a 3 μm polyethylene naphthalate film, the following dye forming composition was coated and dried to a thickness on drying of 0.5 g/m$^2$ to obtain a heat transfer sheet of the present invention. The dye layer ink composition is the same as the ink composition in Example A1, and the heat-resistant layer ink composition the same as in Example A2.

For examples A4, A5 and Comparative Examples A3–A7, by using respectively the substrate films shown below, heat transfer sheets were obtained.

| | |
|---|---|
| Example A4 | 2 μm polyethylene naphthalate film |
| Example A5 | 1 μm polyethylene naphthalate film |
| Comparative Example A3 | 6 μm polyethylene naphthalate film |
| Comparative Example A4 | 2 μm polyethylene terephthalate film |
| Comparative Example A5 | 3 μm polyethylene naphthalate film (without heat-resistant lubricating layer) |
| Comparative Example A6 | 2 μm polyethylene naphthalate film (without heat-resistant lubricating layer) |
| Comparative Example A7 | 6 μm polyethylene naphthalate film |

Resolution Test

The heat transfer sheets of Examples and Comparative Examples and the heat transferable sheet were superposed as opposed to each other, and printing was performed from the back of the heat density of 16 dots/mm under the conditions of a head application voltage of 12.0 V, a printing time of 16.0 msec/line, a running speed of 33.3 msec/line.

The recording portion of the heat transferable sheet recorded was enlarged to 100-fold and a microscope photograph was taken to determine the area per 1 dot.

The values of the dot areas of Examples divided by the dot area of Comparative Example 1 are shown in the following Table. It can be understood that higher resolution image can be obtained as the dot area ratio is smaller.

In all the cases of the heat transfer sheets of Examples, there was little dot blur, and the sheet did not suffer from mechanical breaking.

The states of the transfer sheet after printing are represented as follows.

| | |
|---|---|
| No formation of wrinkle at all | "◎" |
| Wrinkle formed in minute portion, but no effect on printed matter | "○" |
| Wrinkle partially formed | "Δ" |
| Marked wrinkle formed and printed matter difficultly readable | "x" |

TABLE 2

| | Thickness | Heat-resistant lubricating layer | Generation of wrinkle | Resolution | Dot area ratio |
|---|---|---|---|---|---|
| Example A3 | 3 | Do | ◎ | ○ | 0.88 |
| Example A4 | 2 | Do | ◎ | ◎ | 0.79 |
| Example A5 | 1 | Do | ○ | ◎ | 0.72 |
| Comparative Example A4 | 2 | Do | Δ | X | 0.80 |
| Comparative Example A5 | 3 | None | X | Recording impossible | |
| Comparative Example A6 | 2 | None | X | Recording impossible | |
| Comparative Example A7 | 6 | Do | ◎ | X | 1.00 |

In the following, Examples and Comparative Examples by use of EB curing type current passage resistance layer ink and thermal curing are shown.

Form the EB to be used, the electron curtain system low energy type irradiator (manufactured by ESI) is employed, and the curing reaction is carried by performing EB irradiation under the conditions of 175 KeV and 5 Mrad.

EXAMPLE B1

| Heat-resistant resistance layer ink composition | |
|---|---|
| Urethane acrylate (manufactured by Toa Gosei, Japan; Alonix M-1200) | 60 parts |
| Carbon black (manufactured by Asahi Carbon, Japan; HS-500) | 40 parts |

The composition was dispersed in a ball to form an ink, and the resistance layer ink was coated to 4 μm on one surface of PEN (5 μm) through the following heat-resistant primer (1 μm), cured by EB irradiation, and on the other surface was formed a dye layer, to provide Example B1.

| Heat-resistant primer ink composition | |
|---|---|
| Polyurethane resin (manufactured by Showa Ink Kogyo, Japan; DP urethane) | 50 parts |
| Polyisocyanate (manufactured by Nippon Polyurethane, Japan; Coronate 2030) | 1 part |
| MEK/Toluene = 1/1 | 50 parts |

EXAMPLE B2

| Heat-resistant resistance layer ink composition | |
|---|---|
| Thermoplastic polyester resin (manufactured by Toyobo, Japan; Vyron 200) | 40 parts |
| Carbon black (manufactured by Asahi Carbon, Japan; HS-500) | 60 parts |

The composition was dispersed by heating in a kneader, then dispersing 40 parts of urethane acrylate (manufactured by Nippon Gosei Kagaku, Japan; XP-4200B) in a ball mill to form an ink. Otherwise, coating was performed in the same manner as in Example B1 to provide the product as Example B2.

EXAMPLE B3

| Heat-resistant resistance layer ink composition | |
|---|---|
| Dipentaerythritol hexaacrylate | 20 parts |
| Epoxy acrylate (manufactured by Osaka Yukisha, Japan; Biscoat 540) | 40 parts |
| Carbon black (manufactured by Mitsubishi Kasei, Japan; #3750) | 40 parts |

The composition was dispersed by three rolls to form an ink, and the resistance layer ink was coated to 4 μm on one surface of PEN (5 μm) through the following heat-resistant primer (1 μm), cured by EB irradiation, and on the other surface was formed a dye layer, to provide Example B3.

| Heat-resistant primer ink composition | |
|---|---|
| Polyvinyl butyral resin (manufactured by Sekisui Kagaku, Japan; BX-1) | 50 parts |
| Polyisocyanate (manufactured by Nippon Polyurethane, Japan; Coronate 2030) | 2 parts |
| MEK/Toluene = 1/1 | 50 parts |

EXAMPLE B4

| Heat-resistant resistant layer ink composition | |
|---|---|
| Thermoplastic polyester resin (manufactured by Toyobo, Japan; Vyron 200) | 35 parts |
| Carbon black (manufactured by Mitsubishi Kasei, Japan; #3750) | 35 parts |
| MEK/Toluene = 1/1 | 30 parts |

The composition was dispersed in a ball mill to form an ink, and the resistance layer ink was coated to 4 μm on one surface of PEN (5 μm) through the heat-resistant primer (1 μm) of Example B3. Since no monomer was added, no curing by EB irradiation was effected, and then the dye layer was formed in the same manner as in Example B1 to provide Example B4.

COMPARATIVE EXAMPLE B1

By use of PET (6 μm) for the substrate film the heat-resistant resistance layer ink composition of Example B1 was similarly coated, and after curing by EB irradiation the dye layer was similarly coated, to provide the product as Comparative Example B1.

COMPARATIVE EXAMPLE B2

| Resistance layer ink composition | |
|---|---|
| Thermoplastic polyester resin (manufactured by Toyobo, Japan; Vyron 200) | 40 parts |
| Carbon black (manufactured by Asahi Carbon, Japan; HS-500) | 60 parts |
| Methylethylketone/Toluene = 1/1 | 100 parts |

The composition was dispersed in a sand mill to form an ink, and the resistance layer ink was coated to 4 μm on one surface of PET (6 μm) through the following primer (1 μm). Since no monomer was added, no curing by EB irradiation was effected, and then the dye layer was formed in the same manner as in Comparative Example B1 to provide Comparative Example B2.

| Primer ink composition | |
|---|---|
| Polyester resin (manufactured by Toyo Morton, Japan; Adcoat 335A) | 50 parts |
| MEK/Toluene = 1/1 | 50 parts |

EXAMPLE 5

| Heat-resistant resistance layer ink composition | |
|---|---|
| Polyvinyl acetoacetal resin (manufactured by Sekisui Kagaku, Japan; KS-1) | 30 parts |
| Carbon black (manufactured by Mitsubishi Kasei, Japan; #3750) | 30 parts |
| MEK/Toluene = 1/1 | 40 parts |

The composition was dispersed in a sand mill, then the following curing agent was added, the resistance layer ink was coated on one surface of PEN (5 μm) through the heat-resistant primer of Example B1, followed by thermal curing (100° C. 15 minutes), and thereafter following the same procedure as in Example B1, a dye layer was formed to provide Example B5.

| | |
|---|---|
| Isocyanate (manufactured by Nippon Polyurethane, Japan; Coronate 2030) | 50 parts |
| MEK/Toluene = 1/1 | 50 parts |

EXAMPLE B6

| Heat-resistant resistance layer ink composition | |
|---|---|
| Polyvinyl butyral resin (manufactured by Sekisui Kagaku, Japan; BL-3) | 30 parts |
| Carbon black (manufactured by Asahi Carbon, Japan; HS-500) | 30 parts |
| MEK/Toluene = 1/1 | 40 parts |

The composition was dispersed similarly as in Example B5 to form an ink, and then the following curing agent was added to effect thermal curing, followed by the same procedure to provide Example B6.

| | |
|---|---|
| Isocyanate (manufactured by Nippon Polyurethane, Japan; Coronate EH) | 50 parts |
| MEK/Toluene = 1/1 | 50 parts |

COMPARATIVE EXAMPLE B3

By use of PET (6 μm) for the substrate film the heat-resistant resistance layer ink composition of Example B5 was similarly coated through the heat-resistant primer of Example B1 (6 μm), and after thermal curing, a dye layer was similarly formed to provide Comparative Example B3.

COMPARATIVE EXAMPLE B4

| Resistance layer ink composition | |
|---|---|
| Polyvinyl butyral resin (manufactured by Sekisui Kagaku, Japan; BL-3) | 40 parts |
| Carbon black (manufactured by Asahi Carbon, Japan; HS-500) | 30 parts |
| Methylethylketone/Toluene = 1/1 | 30 parts |

The composition was dispersed in a sand mill to form an ink, and the resistance layer ink was coated on one surface of PET (6 μm) through the primer (1 μm) of Comparative Example B2, followed similarly by formation of a dye layer, to provide Comparative Example B4.

By use of the above-mentioned electrothermal transfer recording device, transfer was performed under the following transfer conditions, and the results of adhesion between the substrate and the resistance layer, printing scum, printing quality are shown in Table 3.

| Transfer conditions: | |
|---|---|
| Pulse width | 1 ms |
| Recording period | 2.0 ms/line |
| Recording energy | 3.0 J/cm$^2$ |

Adhesion Test

On the resistance layer surface of the electrothermal heat transfer sheet of Examples and Comparative Examples as described above, a tacky tape (Mending Tape 810-3-18, manufacture by Sumitomo 3M) was adhered under a pressure of 1 kg/m$^2$, and the tape under the state having the current passage heat transfer sheet fixed thereon, was peeled off in the 180° direction, and the adhesion strength of the resistance layer was evaluated.

Printing Scum

By use of the above-mentioned electrothermal transfer recording device, after printing, the electrode head was enlarged by a microscope, and presence or absence of attachment of the resistance layer onto the electrode head was observed.

Printing Quality

By use of the above-mentioned electrothermal transfer recording device, after printing, the recorded state was observed.

TABLE 3

| | Substrate film | Resistance layer crosslinking | Heat-resistant primer | Adhesion | Scum | Printing quality | Overall evaluation |
|---|---|---|---|---|---|---|---|
| Example B1 | Polyethylene terephthalate | Do (EB) | Do | ○ | ○ | ○ | ◎ |
| Example B2 | Polyethylene terephthalate | Do (EB) | Do | ○ | ○ | ○ | ◎ |
| Example B3 | Polyethylene terephthalate | Do (EB) | Do | ○ | ○ | ○ | ◎ |
| Example B4 | Polyethylene terephthalate | None | Do | ○ | Δ | Δ | ○ |
| Example B5 | Polyethylene naphthalate | Do (Heat) | Do | ○ | ○ | ○ | ◎ |
| Example B6 | Polyethylene naphthalate | Do (Heat) | Do | ○ | ○ | ○ | ◎ |
| Comparative Example B1 | Polyethylene naphthalate | Do (EB) | Do | ○ | ○ | X (Wrinkle generated) | Δ |
| Comparative Example B2 | Polyethylene naphthalate | None | None | X | X | X | X (Substrate broken) |
| Comparative Example B3 | Polyethylene naphthalate | Do (Heat) | Do | ○ | ○ | X (Wrinkle generated) | Δ |
| Comparative Example B4 | Polyethylene naphthalate | None | None | X | X | X | X (Substrate broken) |

The standards for evaluations shown in the above Table 3 are as follows.

Adhesion test

◎: no peel-off of dye layer at all
○: small amount and small area of dye layer peeled off
x: dye layer completely peeled off Printing scum ◎: no generation of scum recognized at all
○: attachment of scum recognized on a part of the electrode head
x: attachment of scum recognized on many parts on electrode heads or between electrode heads Printing quality ◎: no generation of printing irregularity, wrinkle recognized at all, but good printing image obtained
○: no thermal fusion of resistance, but printing irregularity occurred
x: white drop-out through thermal fusion occurred

We claim:

1. A heat transfer sheet comprising:

a substrate film comprising a first surface and an opposed second surface, said substrate film comprising a polyethylene naphthalate film having a thickness of 3 microns or less;

a heat migratable dye layer formed on said first surface of said substrate film, said heat migratable dye layer comprising a dye and a binder; and a heat-resistant layer formed on said second surface of said substrate film.

2. The heat transfer sheet according to claim 1, wherein the heat-resistant layer comprises a heat-resistant lubricating layer having lubricity together with heat resistance.

3. The heat transfer sheet according to claim 2, wherein the heat-resistant lubricating layer comprises a substance selected from the group consisting of polyol compounds, polyisocyanates and phosphoric acid esters.

4. The heat transfer sheet of claim 1, wherein at least one layer among the substrate film, the dye layer and the heat-resistant layer contains an antistatic agent.

5. The heat transfer sheet according to claim 1, which is to be used for heat-sensitive sublimation transfer with a resolution of 16 dot/mm or more.

* * * * *